US007647712B2

(12) United States Patent
Tack

(10) Patent No.: US 7,647,712 B2
(45) Date of Patent: Jan. 19, 2010

(54) CUTTER HEAD FOR DREDGING SOIL AND METHOD FOR DREDGING BY MEANS OF THIS CUTTER HEAD

(75) Inventor: Bruno Tack, Turnhout (BE)

(73) Assignee: Dredging International, Zwijndrecht (BE)

( * ) Notice: Subject to any disclaimer, the term of this patent is extended or adjusted under 35 U.S.C. 154(b) by 0 days.

(21) Appl. No.: 11/816,204

(22) PCT Filed: Feb. 17, 2006

(86) PCT No.: PCT/EP2006/060082

§ 371 (c)(1),
(2), (4) Date: Apr. 2, 2008

(87) PCT Pub. No.: WO2006/089866

PCT Pub. Date: Aug. 31, 2006

(65) Prior Publication Data

US 2009/0056173 A1 Mar. 5, 2009

(30) Foreign Application Priority Data

Feb. 22, 2005 (BE) ..... 2005/0093

(51) Int. Cl.
*E02F 3/92* (2006.01)

(52) U.S. Cl. ..... 37/328; 37/326

(58) Field of Classification Search ..... 37/317–324, 37/327–333; 431/18–22, 38, 60–66, 75–90; 415/121.2, 58.4, 58.6, 55.1
See application file for complete search history.

(56) References Cited

U.S. PATENT DOCUMENTS 869,912 A * 11/1907 Knight et al. ..... 37/327
1,226,386 A 5/1917 Sacket
1,939,389 A * 12/1933 Condron ..... 37/333
2,999,324 A 9/1961 Ohlhausen
3,152,409 A * 10/1964 Ramsden et al. ..... 37/322
3,999,616 A 12/1976 Crane et al.
4,320,925 A 3/1982 Bowes, Jr.
4,327,507 A * 5/1982 Volbeda ..... 37/323
4,365,427 A * 12/1982 Chapman, Jr. ..... 37/327
4,371,210 A 2/1983 Leibee
4,412,394 A * 11/1983 Coker ..... 37/318
5,924,222 A 7/1999 Stoetzer
6,843,003 B2 * 1/2005 Araoka ..... 37/317
2002/0104238 A1 8/2002 Ollinger
2004/0172857 A1 9/2004 Deniau et al.

FOREIGN PATENT DOCUMENTS

| | | |
|---|---|---|
| EP | 0557619 | 9/1993 |
| NL | 129899 | 5/1970 |
| RU | 2059069 | 4/1996 |

* cited by examiner

*Primary Examiner*—Robert E Pezzuto
(74) *Attorney, Agent, or Firm*—Novak Druce+Quigg; Jerold I. Schneider

(57) ABSTRACT

A cutter head for dredging soil, which is mountable to the ladder of a suction dredger for dredging soil, and connectable on a suction pipe for removing loosened soil, the cutter head comprising a cage-shaped support construction which is mountable to a drivable rotation shaft extending mainly in extension of the ladder and which has a circumferential surface provided with a number of cuffing tools for penetrating the soil, the cuffing tools comprising a number of disc-shaped penetration bodies of which the disc planes extend substantially perpendicular to the rotation shaft, so that they can transfer forces to the soil via their peripheral edges.

10 Claims, 4 Drawing Sheets

CUTTER HEAD FOR DREDGING SOIL AND METHOD FOR DREDGING BY MEANS OF THIS CUTTER HEAD

TECHNICAL FIELD

The invention relates to a cutter head for a cutter head suction dredger according to the preamble of claim 1. More particularly the invention relates to a cutter head, which is mountable to the ladder of a suction dredger for dredging soil, and connectable on a suction pipe for removing loosened soil. The cutter head comprises a cage-shaped support construction, which is mountable to a drivable rotation shaft extending mainly in extension of the ladder and which has a circumferential surface provided with a number of cutting tools for cutting and/or crushing the soil.

BACKGROUND ART

Such a cutter head (also called cutter) is known, for example from NL-A-9200368. In NL-A-9200368 a cutter head is described with a number of chisels which are mounted around the rotation shaft and which have at least their ends connected by means of a support construction. The support construction of the cutter head forms a conical revolving body of which a first end plane (corresponding to the ground plane) is formed by a circular support ring, and of which the second support plane (corresponding to the top plane) is formed by a hub for connection to the rotation shaft. A number of spiral-shaped ribs extend between the support ring and the hub, which are provided with the chisels. Considered in the direction of the rotation shaft, the chisels are mounted in such way to the ribs that they are oriented more or less tangentially to the rotation direction. Considered from the side, the chisels extend substantially parallel to the ground plane, or enclose a small angle with it.

In order to dredge soil with a suction dredger the cutter head is mounted to the suction dredger by means of a ladder. Such a suction dredger comprises a vessel which is anchored to the ground by means of so-called spud poles, by which a means is created to take up the strong reaction forces which occur during dredging and transfer them to the ground. In the known suction dredger the ladder forms a more or less rigid connection between the cutter head and the suction dredger. Upon dredging underwater soil the cutter head with ladder and suction pipe is lowered under water in a usually slanting direction, until it hits the bottom. In order to be able to trail the cutter head over the bottom the ladder is hauled by means of winches alternately from port side to starboard side so that a more or less circular soil path is worked. The cutter head is rotated relatively slowly (common rotation speeds of 20 to 40 rpm), as a result of which soil pieces are beaten off by the chisels at great force. By each time moving the suction dredger over a given distance and repeating the above described ladder movement, a complete soil area can be dredged.

With the known cutter head the digging operation is achieved by rotating it around the rotation shaft, so that the chisels which are oriented more or less tangentially to the rotation direction beat the soil with their tips. Because of the repeated hammer beatings of the successive chisels the soil is at last shattered into large pieces. These pieces are at least partly sucked up by the suction pipe and removed.

The known cutter head has the disadvantage that the efficiency of the dredging operation, more particularly on soils with a high UCS (Unconfined Compressive Strength), is insufficient. Considerable power is needed to achieve that the chisels beat the soil with sufficient force in order to have pieces which can be sucked up. As used herein, with efficiency is meant the volume dredged soil per unit of time and power.

At present there is also an upper limit of the rock strength that can be dredged. Beyond this limit dredging it is not possible anymore and other very expensive excavation methods such as drilling and blasting, need to be used.

From U.S. Pat. No. 4,320,925 a drilling head is known which comprises disc-shaped cutting tools. This document relates to drilling in dry conditions and does not teach the applicability of disc-shaped cutting tools for dredging underwater soils. This is reflected in the fact that the drilling head is adapted to be driven into the ground, whereas cutter heads for dredging underwater soil are hauled over the ground at the end of a ladder.

DISCLOSURE OF THE INVENTION

It is an aim of the present invention to provide a cutter head for a suction dredger which apart from other advantages needs less power for dredging soils, and which furthermore makes it technically possible to dredge harder soil types more efficiently. A second aim is to be able to dredge rock that, at present, is not dredgeable.

To this end, the cutter head according to the invention is characterized in that the cutting tools comprise a number of disc-shaped penetration bodies of which the disc planes extend substantially perpendicular to the rotation axis, so that they can transfer forces to the ground via their peripheral edges.

By providing the cutter head with cutting tools according to the invention the average load on the cutter head and consequently the average required rotation torque is considerably reduced. This is caused by the fact that the cutter head of the invention operates according to a completely different soil breaking principle with respect to the known cutter head. The operation of the existing cutter head is fully based on the impact of the chisels on the soil, whereas with the cutter head according to the invention the penetration bodies divide up the own weight of the cutter head and as it were "roll" over the ground plane under influence of the hauling force of the winch, and the soil is shattered substantially simultaneously without needing impact.

It is clear that the own weight corresponds to the weight under water of the parts located under water (i.e. the weight of the parts located under water minus the weight of the displaced water).

Because the disc-shaped penetration bodies are mounted with their disc planes substantially perpendicular to the rotation axis on the support construction of the cutter head (or in other words with their disc planes substantially parallel to the rotation direction of the cutter head), they contact the soil with their peripheral edges. The resultant of the own weight of the construction and the exerted winch force of the suction dredger is spread over the contact area between penetrating body and soil. Apparently this creates locally sufficient pressure for shattering the (hard) soil.

Another advantage of the cutter head according to the invention is that the soil chips which are created in this way mostly have smaller dimensions than the pieces which are broken off with the known cutter head, so that they can be easily sucked up by the suction pipe, and pumped further through the pressure pipe. This further enhances the suction efficiency.

Although the cutter head will generally have a conical shape, such as is the case with the known cutter head, the cutter head can be carried out cylindrically if desired, or can have the shape of another revolving body, such as for example a sphere or a sphere segment. The conically shaped revolving body can also have a curved side wall.

The support construction of the cutter head can support the penetration bodies in different ways. For example, it is possible to provide the cutter head of the invention with a support construction which comprises a substantially closed revolving body, in which a number of disc-shaped penetration bodies are accommodated, and which is preferably provided with a number of openings. Such a support construction is very simple to manufacture and offers by way of the openings sufficient capability to suck up the created soil chips.

It is advantageous to provide the cutter head of the invention with a support construction which mainly comprises a number of longitudinal ribs which extend between a hub for connection to the rotation shaft located in a first end plane and a support ring located in a second end plane, and a number of transverse ribs extending substantially perpendicular to the rotation axis, the longitudinal and/or transverse ribs being provided with a number of disc-shaped penetration bodies.

In this way, different transverse ribs provided with penetration bodies can be mounted on the support construction on a given distance from each other, the distance in between being selected depending on the type of soil. In particular, the connection between the longitudinal and transverse ribs is carried out in such a way that the transverse ribs are interchangeable.

If desired, multiple penetration bodies can be mounted in peripheral direction. It is advantageous to distribute the penetration bodies evenly over the support construction. In this way occurring peak loads are reduced, which leads to a more relaxed operation of the cutter head. A more relaxed operation is furthermore enhanced by also distributing the penetration bodies evenly over the support construction in longitudinal direction. It is clear that by providing a support construction with longitudinal and preferably interchangeable transverse ribs a high degree of flexibility is achieved, so that the construction of the cutter head can be easily adapted to the requirements which have to be met for a given type of soil.

During operation the known cutter head usually beats momentaneously with only a few chisels against the soil. This results in a quick wearing out of the chisels, because the full impact force created by the delivered torque has to be carried by only a few chisels. The cutter head of the invention has the important advantage that multiple penetration bodies distributed over the mantle surface of the support construction can be momentaneously in contact with the soil, so that they will experience less wear. Furthermore, if desired it is possible to maintain the number of penetration bodies which is simultaneously in contact with the soil more or less constant, so that the force which is exerted per penetration body remains substantially the same.

The penetration means of two successive transverse ribs can in principle be positioned in all possible ways with respect to each other. In order to further enhance the dredging efficiency it is however advantageous to mount a disc-shaped penetration body offset with respect to the nearest penetration bodies, so that they can cover a larger working width than the width of a single penetration body.

As used herein, with offset is meant that with respect to the cutting direction (or movement direction) of the cutter head, the different penetration bodies are mounted laterally disposed behind and/or next to each other, their disc planes being directed substantially parallel to the cutting direction (so the disc axes are substantially perpendicular to the cutting direction of movement direction). By mounting the penetration bodies in this way the realized production will be higher than the accumulated production of each separate penetration body.

The distance in between the penetration bodies in longitudinal and circumferential direction is amongst others determined by the dimensions of the penetration bodies and the total underwater weight, and also the hauling force created by the pulling operation of the winch. Apart from that, the characteristics of the soil are important, for example the compressive strength/tensile strength proportion of the soil. It is clear that a suitable choice of the distance in between the penetration bodies can be easily made by the person skilled in the art starting from the above mentioned parameters.

The cutter head is moved by the hauling operation of the winches, during which the cutter head according to the invention contacts the soil substantially only by means of the penetration bodies. The cutter head is consequently preferably provided with disc-shaped penetration bodies which are accommodated rotatably around their axis—the axis perpendicular to the disc plane—in the support construction, the rotation axis extending substantially perpendicular to the hauling direction. In this way, the torque needed for the rotation of the cutter head is reduced.

In particular the disc-shaped penetration bodies can thereto be accommodated pivotally around their disc axis in an accommodation body, which according to the invention is preferably releasable from the support construction. It is possible to accommodate multiple penetration bodies in an accommodation body, although mostly one accommodation body will be provided per penetration body. Such a construction has the advantage that a penetration body can be easily replaced in the event of breakage or other damage.

The known cutter head has to be pressed into the soil with a great axial force in order to have a good operation. Without sufficient force, the chisels have insufficient grip on the soil as a result of which it will not be broken up, and the cutter head will as it were "jump" over the soil. Because such an axial force is necessary for the good operation of the known cutter head, the connection between the cutter head and the suction dredger is essentially rigid. As a result it is not possible to use the known cutter head in heavier weather conditions because the increased swell will move the suction dredger up and down, whereby the ladder between suction dredger and cutter head will be exposed to too strong axial forces (hammering of the cutterhead into the rock).

Because the cutter head according to the invention has a different operation principle, it does not have to be pressed axially into the soil for a good operation. This offers the ability to provide the cutter head according to the invention with a support construction which is connected to the rotation shaft by means of a resilient connection. By mounting the cutter head resiliently with respect to the ladder and/or the suction dredger an occurring vertical and/or horizontal movement of the suction dredger as a result of swell can be easily taken up by the resilient connection. This enables ongoing operation even in heavier weather conditions which yields a substantial economic advantage.

The soil is at least partly shattered by the operation of the penetration bodies of the cutter head. Apparently the efficiency of the shattering operation can be enhanced by providing the cutter head with at least one array of jet pipes for injecting water, preferably at high pressure. Common pressures are usually around 10 to 15 bar, but it is advantageous to provide jet pipes for injecting water under pressure, with the common pressures being between about 50 and about 900 bar. If desired, even higher pressures up to 2500 bar are possible.

According to the invention, the jet pipes can be mounted in front of and/or behind and/or at the support body with penetration bodies. When mounted behind the penetration body, the fluid which is injected under high pressure in the at least partly shattered soil will aid in removing the soil chips via the suction pipe, and/or further reducing and/or fluidising the soil particles which are already broken off. When mounted in front of the penetration body, the fluid which is injected under high pressure in the not yet shattered soil will aid in removing softer ground layers from the soil, so that a better defined ground surface is created in which the penetration bodies can penetrate better. A second advantage of this mounting is the creation of an initial groove by which the penetration depth of the penetration body will increase. When mounted at the support body with penetration bodies, the fluid is injected under high pressure in the possibly not yet completely shattered hard soil underneath a penetration body. As a result, the fluid will penetrate into the cracks which are already partly formed and so speed up the shattering of the soil. Since the high pressure water jets remove the shattered soil particles also the wear of the penetration bodies will be reduced.

With respect to the dimensions of the penetration bodies it can be remarked that these will amongst others be selected in function of the expected pressure forces and the operational width. The diameter of the penetration bodies can vary between a few cm and multiple decimeters. Especially suitable diameters are between 5 and 80 cm. Penetration bodies with such diameters show a good balance between the power required per $m^3$ dredged soil and the dredging efficiency to be achieved, i.e. the number of $m^3$ dredged soil per second. More preferably the cutter head according to the invention is characterized in that the diameter of the penetration bodies is between 10 and 40 cm. Such preferred diameters lead to a deeper penetration in the same soil. As a result, a higher efficiency is achieved. If the diameter of the penetration bodies becomes too small, the penetration may be further enhanced, but this will be at the expense of the movement of the cutter head, which will experience a higher roll- or haul resistance. Because of the increased resistance a higher torque and consequently more cutter head power is needed.

The invention further relates to a method for breaking up and/or dredging of at least partly hard underwater soils with a suction dredger equipped with a cutter head according to the invention.

BRIEF DESCRIPTION OF THE DRAWINGS

The cutter head according to the invention will be further elucidated by means of the following description of preferred embodiments and drawings, without limiting the invention. The reference numerals relate to the appended drawings.

MODES FOR CARRYING OUT THE INVENTION

Figure 1:
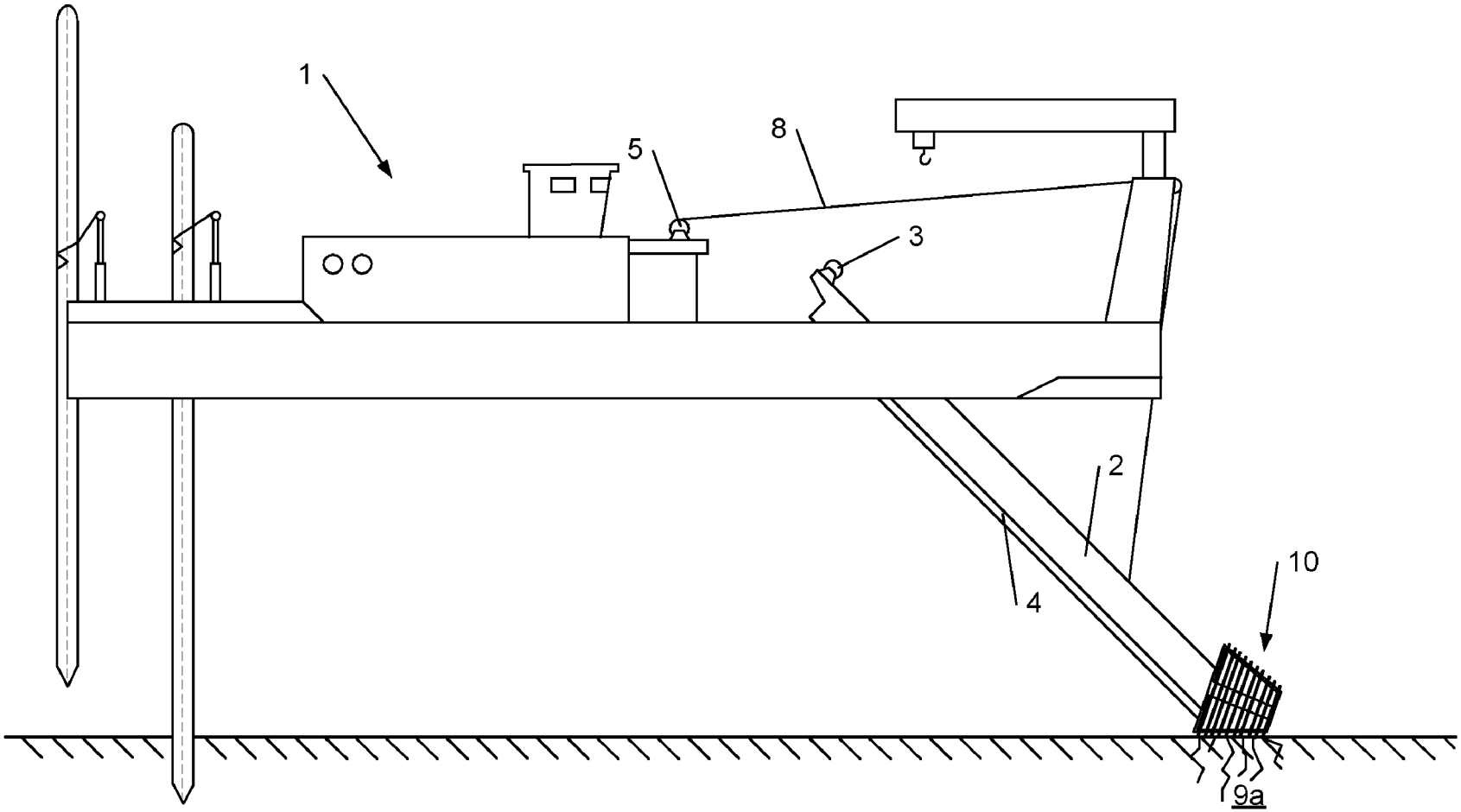
FIG. 1 is a schematic side view of a part of the suction dredger with connected ladder, provided with a cutter head according to the invention.

FIG. 1 shows a suction dredger 1 to which a ladder 2 is pivotally connected around a horizontal axis 3. The ladder is provided with a suction pipe 4 which sucks up loosened soil parts to above the water surface. The ladder 2 is hauled over the bottom surface 9 by means of a winch 5 and winch cables 8. The ladder 2 is provided at its end with a cutter head 10 according to the invention. In order to yield a horizontal surface the mantle surface of the cutter head 10 preferably has a conical shape. The conicity of the cutter head 10 is chosen in function of the angle which the ladder 2 forms with the ground surface 9 and/or in function of the dredging depth. In another preferred embodiment the cutter head 10 is pivotally connected to the ladder 2 by means of a pivot 6. In this way always a substantially horizontal surface can be yielded, this being strongly dependent on the ladder angle. The angle between the axes of the cutter head 10 and the ladder 2 can then for example be set by means of piston 7.

The cutter head 10 (see FIG. 2) comprises a support construction 11 which mainly comprises a number of longitudinal ribs 12 which extend between a hub 13 located in a first end plane I-I for connection to the rotation shaft 14 and a support ring 15 located in a second end plane II-II. Hub 13 can be connected to the shaft 14 in any known way, for example by means of a screw-connection. The support construction 11 further comprises a number of ring-shaped transverse ribs 16 extending perpendicular to the rotation shaft 14. In the embodiment of the cutter head 10 shown in FIG. 2 only the transverse ribs 16 are provided with a number of cutting tools 20 according to the invention. If desired it is possible to provide also the longitudinal ribs 12 with cutting tools 20. The cutting tools 20 according to the invention comprise disc-shaped penetration bodies 21 of which the disc planes III-III (see also FIG. 4) extend substantially perpendicular to the rotation shaft 14, so that they can transfer forces to the ground via their peripheral edges 22. It is clear that with the terminology "substantially transverse" also penetration bodies are meant whose disc-planes enclose a limited angle with the rotation shaft 14, as long as it is possible to transfer forces to the ground via the peripheral edges 22. It is for example possible that the disc-planes of the penetration bodies 20 extend substantially perpendicular to the longitudinal ribs 12, so that they are more or less perpendicular to the ground surface 9 (see FIG. 1) during use. The disc-planes in this embodiment enclose an angle with the rotation shaft 14.

Figure 4:
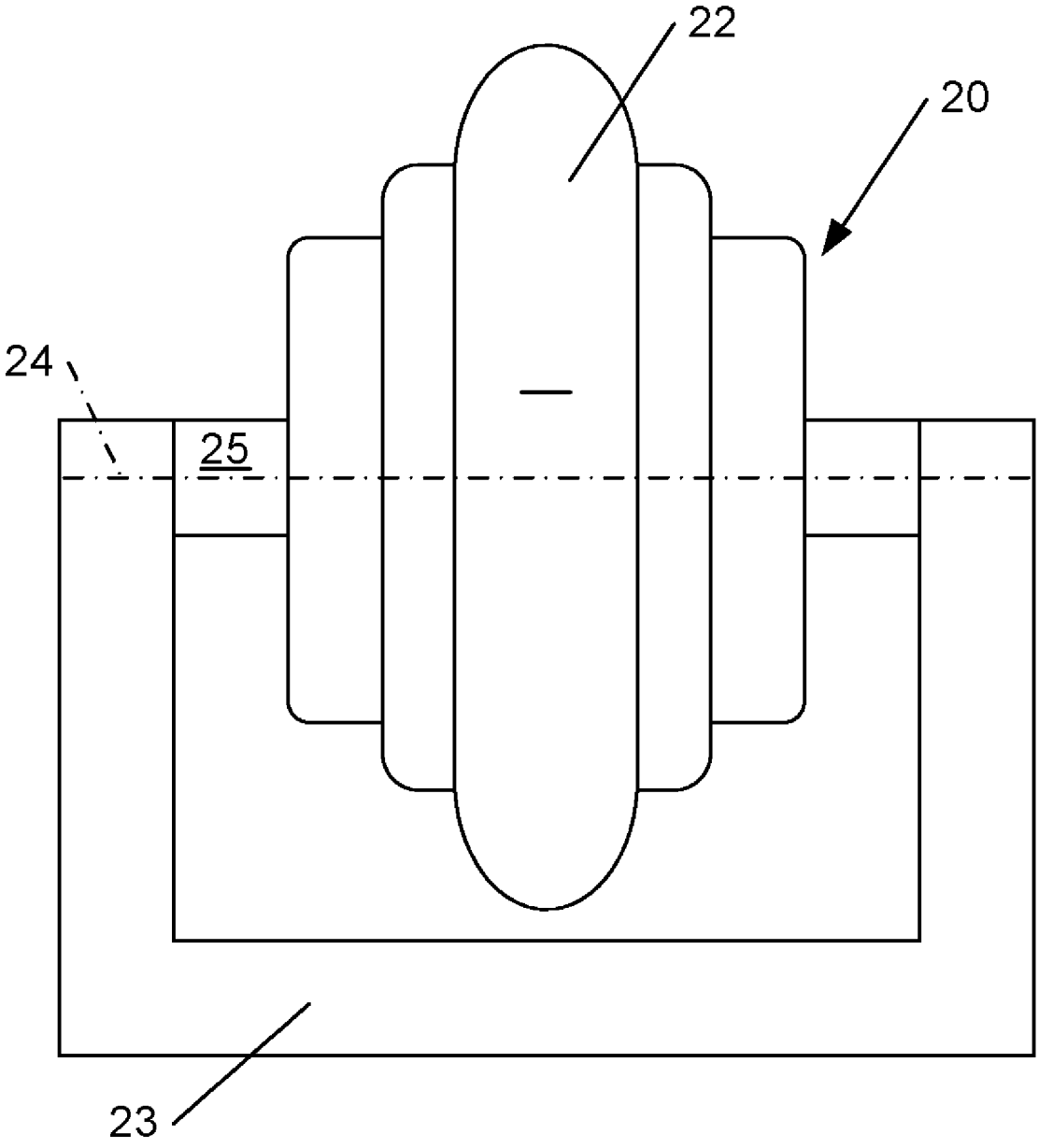
FIG. 4 shows a side view of a detail of an accommodation body with a rotatable penetration body accommodated in it.

In FIG. 4 a preferred embodiment of a cutter tool 20 is shown of which the disc-shaped penetration body 21 is pivotally accommodated around its disc axis 24 in an accommodation body 23. The accommodation body 23 comprises a U-shaped profile which is constructed with the desired length. The accommodation body 23 is further preferably provided with at least one axis pen 25 in which the disc-shaped penetration body 21 can be pivotally accommodated. It goes without saying that the dimensions and the material of the penetration body 21, accommodation body 22 and axis pen 25 are to be selected such that they can withstand the loads occurring during dredging. If desired the axis pen 25 is accommodated in the accommodation body 23 by means of suitable bearings.

The accommodation body 23 can be connected to the longitudinal ribs 12 and/or the transverse ribs 16 in a manner known to the person skilled in the art, for example a welded connection, a fitted connection with the accommodation body 23 is placed in a corresponding opening of the respective rib, and possible sealed by means of a cross pen, a screw connection etc. The accommodation body 23 is preferably releasably connected to the support construction and/or its ribs, for example by means of a fitted connection.

The penetration of the penetration bodies 22 in the hard material of the bottom 9 can occur at any desired depth, depending on amongst other the dimensions of the penetration body 21 used, the power which is presented, the specific characteristics of the soil 9, the pull force of the winch cables 8, and the number and the distribution of the penetration bodies 21 over the mantle surface of the cutter head 10.

Figure 2:
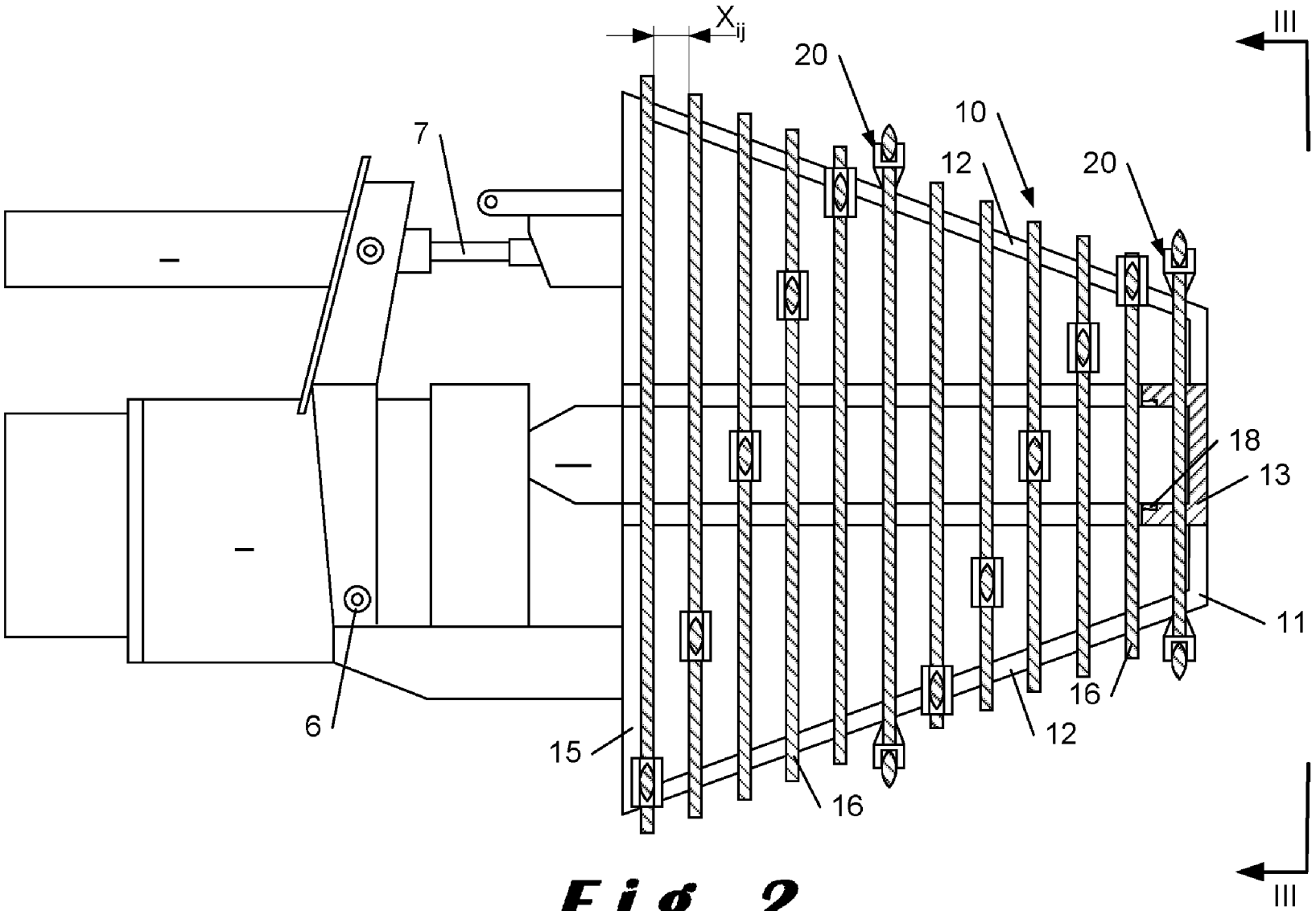
FIG. 2 is a schematic side view of a cutter head according to the invention.
Figure 3:
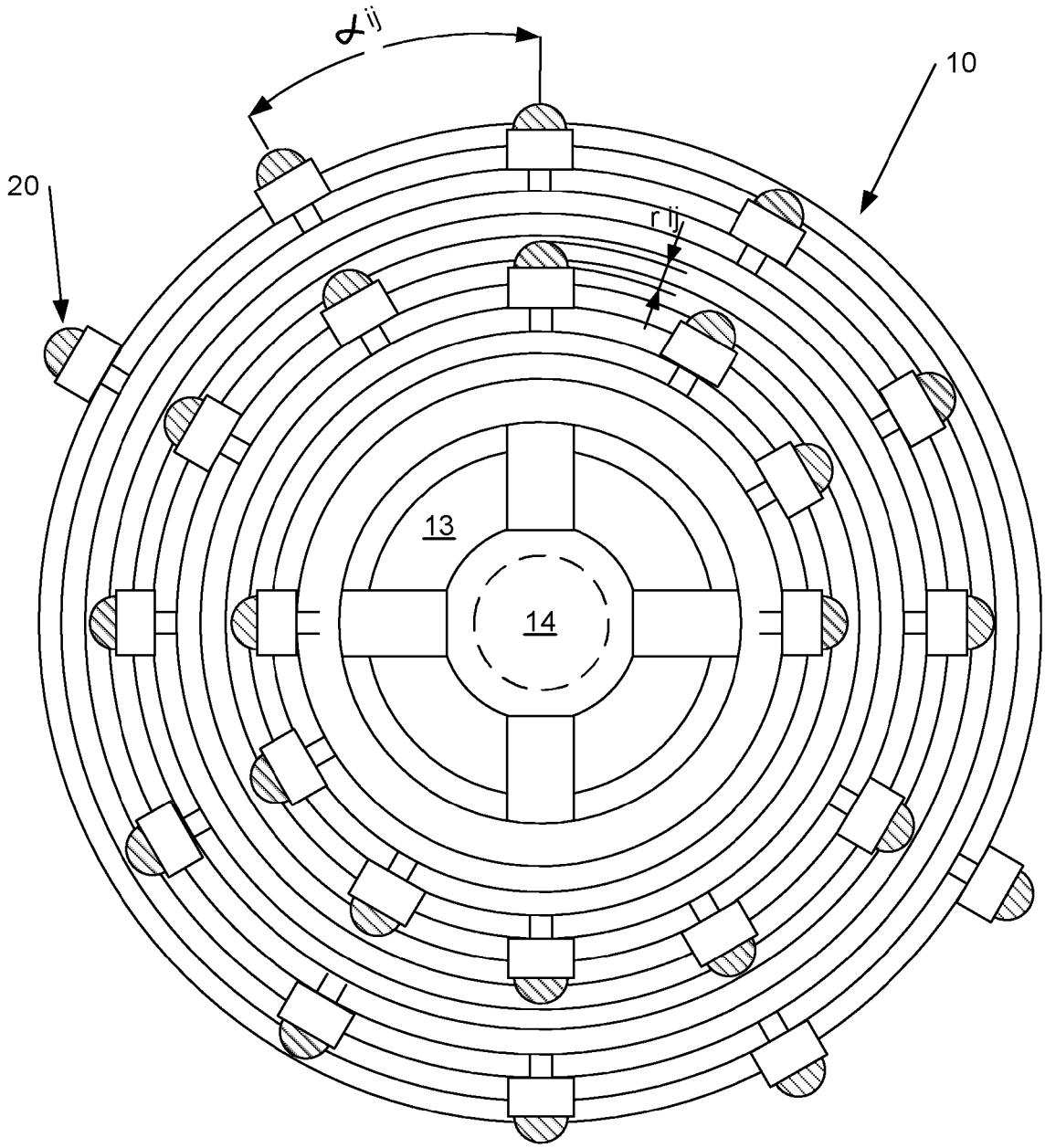
FIG. 3 schematically shows a front view of the cutter head of FIG. 2 seen in the direction of the rotation shaft.

As shown in FIGS. 2 and 3 the cutting tools 20 are distributed over the mantle surface of the cutter head 10 by means of the mutual distance $x_{ij}$ in longitudinal direction between two successive transverse rings 16 (i and j) of cutter head 10, the mutual distance $r_{ij}$ in radial direction between two successive transverse ribs 16 (i and j), and the angle $\alpha_{ij}$ in circumferential direction between two successive cutting tools 20 (i and j). Preferably the cutting tools 20 (or the penetration bodies 21 which means the same) are evenly distributed over the support construction 11 in circumferential direction as well as in longitudinal direction. The mutual distances $x_{ij}$ are amongst others determined by the desired number of cutting tools which simultaneously needs to be in contact with the soil, the compressive strength/tensile strength proportion of the soil, and other factors. Common mutual distances are for example between 5 and 50 cm.

The support construction 11 of the cutter head 10 according to the invention is preferably connected to the rotation shaft 14 by means of a flexible connection 18, such a flexible connection 18 can be easily realized by the skilled person and is preferably carried out such that the cutter head 10 with penetration bodies 21 is slidable substantially in extension of the rotation shaft 14. By resiliently suspending the support construction 11 it is achieved that dredging can go on even in heavy weather conditions, without causing damage, for example to the ladder 2. The flexible connection 18 can be carried out in any manner known to the person skilled in the art. As an example, it is possible to use mechanical, hydraulic and/or pneumatic resiliency systems. In this respect it is advantageous to have a settable spring constant, depending on the condition and the characteristics of the soil.

The cutter head 10 further preferably comprises at least one array of jet pipes for injecting water under high pressure. The jet pipes can inject water or any other suitable fluid, possibly under high pressure, into the soil. The ducts needed for this can be supplied via the ladder 2 and/or the suction pipe 4. Upon hauling the cutter head through the bottom the penetration bodies 21 will develop a high pressure on the hard soil 9 by means of their peripheral edges 22, as a result of which the soil 9 will at least partly be shattered at its contact surface with the penetration body 21. The injected water jets, preferably directed at the bottom part which is right underneath a penetration body 21, can possibly aid in loosening sand or sedimented hard ground particles, which can then be sucked up more easily. If desired a second array of jet pipes can be provided. The jet pipes are aimed at better, i.e. deeper fluidizing the soil at the height of the injection and at further shattering and loosening and/or pre-cutting the loosened hard soil.

In order to prevent that, upon sucking off the broken off ground material, supply water would be supplied along the relatively unproductive sides of the cutter head 10, the cutter head 10 be provided with a closure cap at these locations.

The invention is not limited to the above described embodiments, to which adaptations can be carried as long as these remain within the scope of the appended claims.

What is claimed is:

1. Cutter head for dredging soil, which is mountable to a ladder of a suction dredger for dredging soil, and connectable on a suction pipe for removing loosened soil, the cutter head comprising a cage-shaped support construction which is mountable to a drivable rotation shaft extending mainly in extension of the ladder and which has a circumferential surface provided with a number of cutting tools for cutting the soil, wherein the cutting tools comprise a number of disc-shaped penetration bodies, extending substantially perpendicular to the rotation shaft, so that said penetration bodies can transfer forces to the soil via the peripheral edges of said penetration bodies.

2. Cutter head according to claim 1, wherein the support construction mainly comprises a number of longitudinal ribs which extend between a hub for connection to the rotation shaft located in a first end plane and a support ring located in a second end plane, and a number of ring-shaped transverse ribs extending substantially perpendicular to the rotation shaft, the ribs being provided with a number of disc-shaped penetration bodies.

3. Cutter head according to claim 1, wherein the disc-shaped penetration body is pivotally accommodated around the disc axis of said penetration body in an accommodation body.

4. Cutter head according to claim 3, wherein the accommodation body is releasable from the support construction.

5. Cutter head according to claim 1, wherein the penetration bodies are evenly distributed in circumferential direction over the support construction.

6. Cutter head according to claim 1, wherein the penetration bodies are evenly distributed in longitudinal direction over the support construction.

7. Cutter head according to claim 1, wherein the support construction is connected to the rotation shaft by means of a flexible connection.

8. Cutter head according to claim 1, wherein the cutter head comprises at least one array of jet pipes for injecting water under high pressure.

9. Method for dredging at least partly hard underwater soils with a suction dredger, equipped with a cutter head for dredging soil which is mountable to a ladder of a suction dredger for dredging soil and connectable on a suction pipe for removing loosened soil, wherein the cutter head comprises a cage-shaped support construction which is mountable to a drivable rotation shaft extending mainly in extension of the ladder and which has a circumferential surface provided with a number of cutting tools for cutting the soil, wherein the cutting tools comprise a number of disc-shaped penetration bodies of which the disc planes extend substantially perpendicular to the rotation shaft, so that said penetration bodies can transfer forces to the soil via the peripheral edges of said penetration bodies, wherein the method comprises the steps of:(a) lowering the cutter head by means of the ladder onto the soil and hauling the cutter head in the soil by means of at least one winch, such that the disc-shaped penetration bodies at least partly contact the soil and at least partly penetrate the soil under the weight of the ladder and cutter head and the pulling force exerted by the winch,(b) sucking up soil chips which are broken off in step (a) by means of the suction pipe.

10. Method according to claim 9, further comprising the step of injecting water under high pressure into the soil by means of at least one array of jet pipes on the cutter head.

* * * * *